US008156669B2

(12) United States Patent
Maj

(10) Patent No.: US 8,156,669 B2
(45) Date of Patent: Apr. 17, 2012

(54) HOT AIR OUTDOOR ADVERTISING STRUCTURE

(76) Inventor: Krysztof Maj, Chorzów (PL)

( * ) Notice: Subject to any disclaimer, the term of this patent is extended or adjusted under 35 U.S.C. 154(b) by 139 days.

(21) Appl. No.: 12/743,987

(22) PCT Filed: Nov. 27, 2008

(86) PCT No.: PCT/PL2008/000090

§ 371 (c)(1),
(2), (4) Date: Jun. 11, 2010

(87) PCT Pub. No.: WO2009/070044

PCT Pub. Date: Jun. 4, 2009

(65) Prior Publication Data

US 2010/0325925 A1 Dec. 30, 2010

(30) Foreign Application Priority Data

Nov. 29, 2007 (PL) ..... 117131 U

(51) Int. Cl.
*A47G 1/06* (2006.01)

(52) U.S. Cl. ..... 40/214; 40/610; 224/31

(58) Field of Classification Search ..... 40/214, 40/610; 244/31; 446/220–226
See application file for complete search history.

(56) References Cited

U.S. PATENT DOCUMENTS

| | | | | | |
|---|---|---|---|---|---|
| 1,642,022 | A | * | 9/1927 | Groh | 40/212 |
| 2,165,610 | A | * | 7/1939 | Boyle | 244/33 |
| 3,116,037 | A | * | 12/1963 | Yost | 244/31 |
| 3,170,658 | A | * | 2/1965 | Yost | 244/98 |
| 3,229,932 | A | * | 1/1966 | Yost | 244/31 |
| 3,526,199 | A | * | 9/1970 | Keats | 156/93 |
| 4,369,591 | A | * | 1/1983 | Vicino | 40/610 |
| 4,597,633 | A | * | 7/1986 | Fussell | 359/451 |
| 4,920,326 | A | * | 4/1990 | Agarwala | 335/284 |

FOREIGN PATENT DOCUMENTS

| | | | |
|---|---|---|---|
| DE | 29806145 | U | 7/1998 |
| FR | 2305340 | A | 10/1976 |
| GB | 1487303 | A | 9/1977 |
| WO | WO03/088197 | A | 10/2003 |

OTHER PUBLICATIONS

International Search Report.

* cited by examiner

*Primary Examiner* — Joanne Silbermann
*Assistant Examiner* — Shin Kim
(74) *Attorney, Agent, or Firm* — William J. Sapone; Coleman Sudol Sapone P.C.

(57) ABSTRACT

The invention relates to a hot air outdoor advertising structure comprising an envelope (1) having at least one substantially flat surface and an opening for hot air supply in its lower part. The envelope (1) is secured to the ground by means at least two fixing ropes (8) and comprise at least one joining rope (7) having ends connected inside to the opposite side walls of the envelope (1), and at least four carrying ropes (6), having upper ends connected from inside to the upper wall of the envelope (1) and lower ends connected with at least one elastic coupler (5) being connected by means of at least four intermediate ropes (4) with a hot air supply device (2, 15, 17). The hot air supply device is preferably a basket (3) suspended to the intermediate ropes (4) and connected to a heating device placed on the ground. A source of light may be preferably installed in the interior of the envelope (1) and/or a projection screen sheet may be attached to the envelope (1). The invention encompasses the features of a hot air balloon and large scale advertisement.

10 Claims, 3 Drawing Sheets

HOT AIR OUTDOOR ADVERTISING STRUCTURE

BACKGROUND

The invention relates to a hot air outdoor advertising structure comprising an envelope having at least one substantially flat surface and an opening for hot air supply in its lower part. The invention encompasses the features of a hot air balloon and large-scale advertisement.

Known hot air balloons having oval drop-like shape are used mainly for sports or recreational flights. They may be additionally employed to expose sponsor advertisements.

Hot air balloon envelopes are also made in various shapes, such as beer can, car, lollypop, etc. These balloons are used as human-carrying devices but also advertise particular product or brand.

Similar functions perform hot air dirigibles which are used for sports or recreational flights and additionally to expose sponsor advertisements.

In the above mentioned types of hot air airships, hot air that makes the ship airborne is heated by means of flame of a gas burner installed in. a basket suspended beneath the airship. In the case of balloons the basket is suspended to bands or ropes that are attached around the balloon envelope. Hot air fills up the envelope and makes it tensioned, thus tensioning also carrying bands/ropes.

In case of hot air dirigibles ropes are suspended in a multipoint manner, mainly to the upper part of the envelope.

The above mentioned airships are manned ships, intended mainly for making flights, but additionally they may also be used to perform advertising function during a flight as well as during ground presentations.

Another type of known balloons that may be used to perform advertising function are structures filled up with light gases. An exemplary structure of this kind is disclosed in patent document GB-A-1 487 303. The document describes an aerial display device consisting of a light rigid structure constituting or bearing the display matter, and partly enclosing a chamber or bag containing a gas less dense than air, the device being tethered to the ground by a cable. Preferably, the rigid structure is of sheets of expanded polystyrene, externally painted or bearing posters, or cut to the shape of certain articles. Alternatively the structure may be of glass reinforced plastics, light alloy or hardboard. The gas may be helium, hydrogen or hot air. The display may be illuminated by ground based spot lights or by lamps on the device supplied by wires running up the cable.

SUMMARY OF THE INVENTION

According to the invention there is provided a hot air outdoor advertising structure which is characterized in that the envelope is secured to the ground by means of at least two fixing ropes and comprise at least one joining rope having ends connected from inside to the opposite side walls of the envelope, and at least four carrying ropes, having upper ends connected from inside to the upper wall of the envelope and lower ends connected with at least one elastic coupler, said coupler being connected by means of at least four intermediate ropes with a hot air supply device.

The advertising structure according to the invention constitutes a buoyant body of a shape enabling presentation of large-size advertising which flies above the ground owing to hot air that fills it up. On the side surfaces of the structure advertisements may be exposed having forms including attached banners, advertising overprints printed directly on the structure envelope or advertisements projected on the envelope from an external projector.

Upward flight of the structure according to the invention is achieved by heating the air in the interior space of the envelope, while an appropriate tension of the side surface of the envelope is obtained by heating the air in the interior space of the structure envelope and tensioning the ropes connecting the envelope to the ground.

In a preferred embodiment of the invention, the hot air supply device is a basket suspended to the intermediate ropes and provided with a gas burner.

In such a case it is additionally preferable if the advertising structure comprises a conduit supplying the gas burner with a gas remotely from a ground gas installation, which is preferably a compressed gas cylinder.

Owing such a construction, the structure according to the invention may be operated entirely from the ground (handling the carrying ropes tethering the structure and controlling gas installation) or in a case of a gas cylinder installed in the basket, partially from the ground and partially from the basket (controlling the burner).

Alternatively, it is preferably if the hot air supply device is an outlet of an air duct suspended to the intermediate ropes and connected to a heating device placed on the ground.

In such a case an inlet of an the air duct, working in a close cycle together with the heating device placed on the ground and the air duct supplying hot air, is also suspended to the intermediate ropes.

Thus supplying hot air may be thus realized in an open circuit, where air to be heated is taken from the outside, heated and supplied by means of a burner or air duct to the envelope, or in a closed circuit, where air is evacuated from the interior space of an envelope via air duct, subsequently heated on the earth and pumped via a second air duct back to the interior of the envelope.

The envelope of a structure according to the invention is preferably of prism shape, in particular of a cuboid shape.

Hot air, outdoor advertising structure according to the invention provides new perspectives for development of outdoor large-size advertising employed outside the city centres.

BRIEF DESCRIPTION OF THE DRAWINGS

The invention is illustrated below with reference to the preferred exemplary embodiments thereof and with reference to the attached drawings on which.

DETAILED DESCRIPTION OF THE INVENTION

Figure 1:
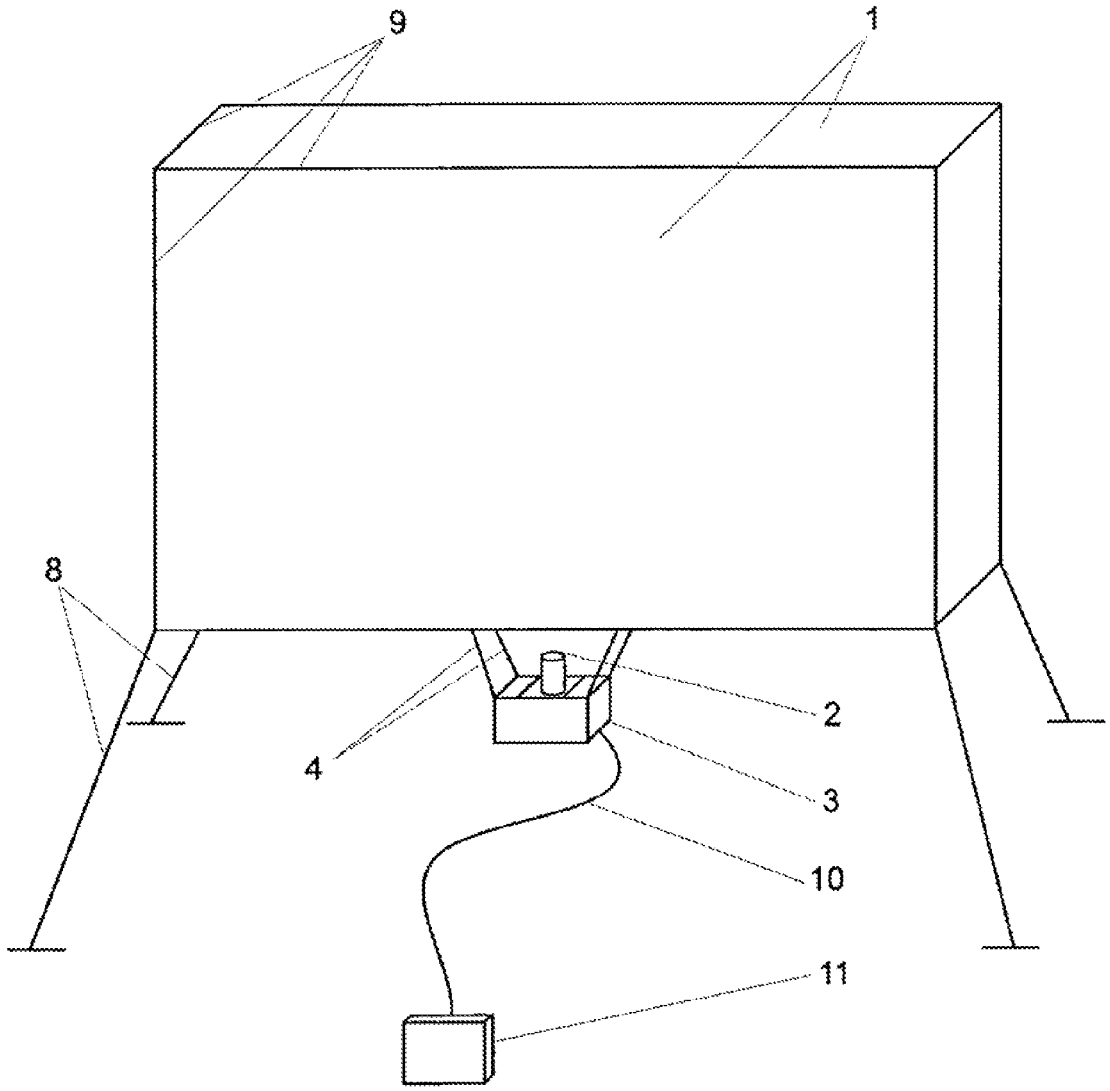
FIG. 1 shows a perspective view of a hot air outdoor advertising structure.
Figure 2:
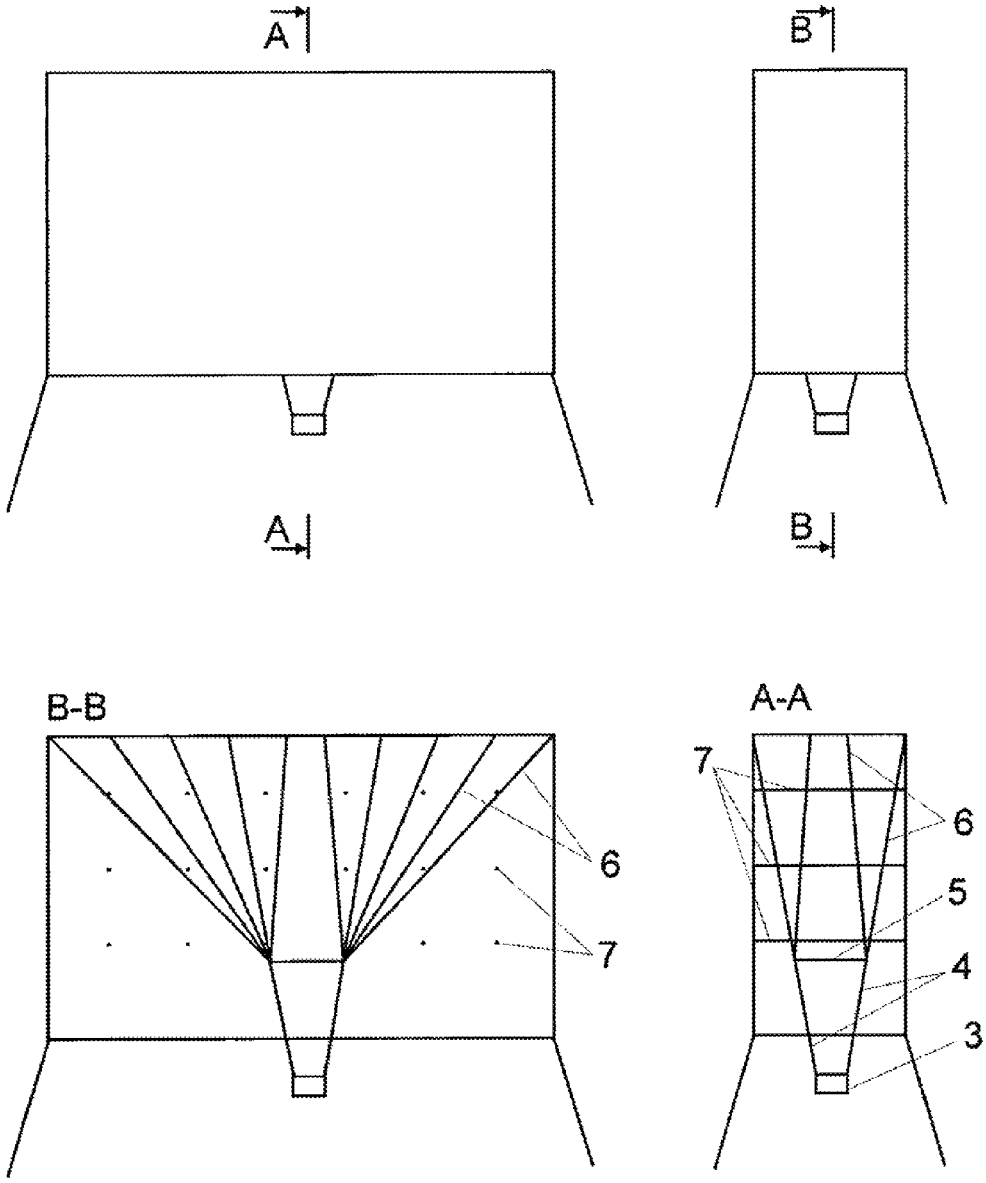
FIG. 2 shows cross-sectional view of an advertising structure.

An exemplary hot air outdoor advertising structure as shown in FIG. 1 and FIG. 2 is substantially comprised of a cuboidal envelope 1, sustained above the ground by means of hot air supplied by the flame of a gas burner 2, secured in a basket 3 suspended beneath the envelope 1 by means of four intermediate ropes 4, connected in turn with four couplers 5, which are connected with twenty carrying ropes 6 fixed from the inside to the upper part of the envelope on the whole perimeter and surface thereof. Opposite side walls of the envelope are connected by means of eighteen joining ropes 7 that maintain desirable shape of side surfaces of the stricture body. Fixing ropes 8 connected to the envelope 1 and fixed to the ground on their other ends tether the advertising structure and generate appropriate tension of side surfaces of the envelope 1. On the edges of the envelope 1 there are bands 19 (e.g. velcro bands) installed using for attaching sheets of material comprising advertising overprints to the envelope.

The gas burner 2 mounted in to basket 3 is supplied with gas in appropriate sequences via conduits 10 from a gas cylinder 11 placed on the ground.

Figure 3:
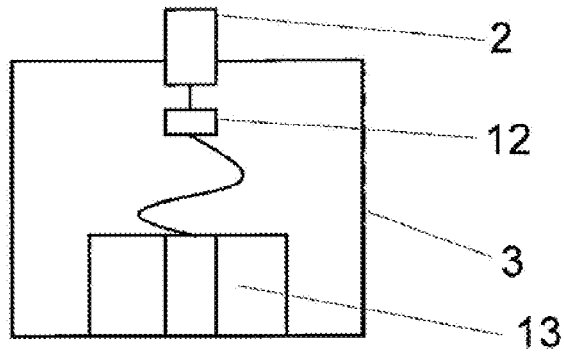
FIG. 3, FIG. 4, FIG. 5 illustrate alternate and additional construction details of the invention.
Figure 4:
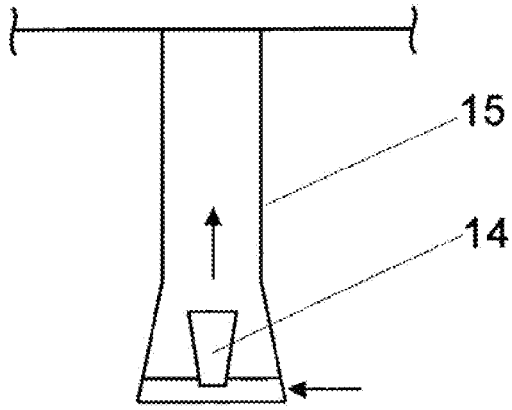
Figure 5:
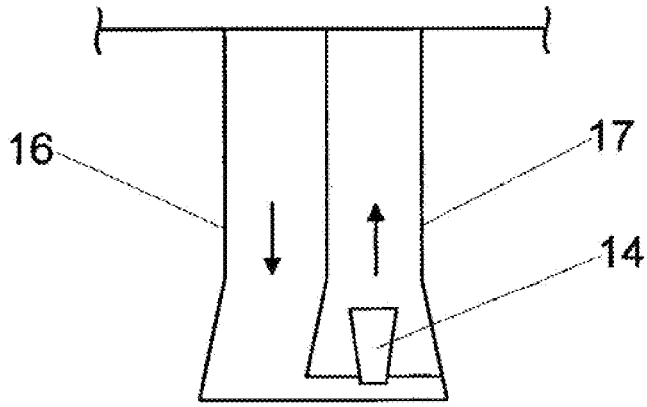

FIGS. 3-5 illustrate alternative systems for supplying hot air. As shown in FIG. 3 gas is supplied to the burner from a cylinder 13 mounted in the basket using an electro valve 1 controlled remotely from the ground.

It is also possible to generate hot air using heating device placed on the ground. This mode of hot air supplying may be realized in an open circuit as shown in FIG. 4, where air to be heated is taken from the outside, heated in a heating device 14 and supplies via air duct 15 to the envelope, or as shown in FIG. 5 in a closed circuit, where air is evacuated from the interior space of an envelope via air duct 16, subsequently heated on the earth and pumped via a second air duct 17 back to the interior space of the envelope.

In order to make the advertising message being more clearly visible, especially at night, the structure according to the invention may be additionally provided with a light source (s) installed in the interior of the envelope. Further, in order to enable to project advertising communicates from a slide or video projector directly on the structure, an appropriate blank sheet of material serving as a projection screen for an external projector may be attached to the envelope, particularly to the envelope side surface in place of a sheet with advertisement printed thereon.

The invention claimed is:

1. A hot air outdoor advertising structure comprising an envelope having at least one substantially flat surface and an opening for hot air supply in its lower part, characterized in that, the envelope (1) is secured to the ground by means at least two fixing ropes (8) and comprise at least one joining rope (7) having ends connected from inside to the opposite side walls of the envelope (1), and at least four carrying ropes (6), having upper ends connected from inside to the upper wall of the envelope (1) and lower ends connected with at least one elastic coupler (5), said coupler (5) being connected by means of at least four intermediate ropes (4) with a hot air supply device (2, 15, 17).

2. The hot air outdoor advertising structure according to claim 1, characterized in that, the hot air supply device is a basket (3) suspended to the intermediate ropes (4) and provided with a gas burner (2).

3. The hot air outdoor advertising structure according to claim 2, characterized in that, it comprises a conduit (10) supplying the gas burner (2) remotely from a ground gas installation.

4. The hot air outdoor advertising structure according to claim 3, characterized in that, the ground gas installation is a compressed gas cylinder (11).

5. The hot air outdoor advertising structure according to claim 1, characterized in hit, the hot air supply device is an outlet of an air duct (15, 17) suspended to the intermediate ropes (4) and connected to a heating device (14) placed on the ground.

6. The hot air outdoor advertising structure according to claim 5, characterized in that it, an inlet of an the air duct (16), working in a close cycle together with the heating device (14) placed on the ground and the air duct (17) supplying hot air, is suspended to the intermediate ropes (4).

7. The hot air outdoor advertising structure according to claim 1, characterized in that, the envelope (1) has a prism shape.

8. The hot air outdoor advertising structure according to claim 1, characterized in that, at least one source of light is installed in the interior of the envelope (1).

9. The hot air outdoor advertising structure according to claim 1, characterized in that, at least one projection screen sheet is attached to the envelope (1).

10. The hot air outdoor advertising structure according to claim 1 characterized in that the envelope (1) has a cuboid shape.

* * * * *